United States Patent [19]

Nakamura

[11] 4,117,573

[45] Oct. 3, 1978

[54] PACKING BAND TIGHTENING DEVICE

[75] Inventor: Minoru Nakamura, Osaka, Japan

[73] Assignee: Idemitsu Lion Co., Ltd., Ichihara, Japan

[21] Appl. No.: 821,812

[22] Filed: Aug. 4, 1977

[51] Int. Cl.[2] ..... A44B 11/00; A44B 11/02

[52] U.S. Cl. ..... 24/74 A; 24/22; 24/200

[58] Field of Search ..... 24/23 B, 74 A, 200, 24/198, 197, 193, 169, 196, 68 E, 69 SB, 68 SB, 70 ST, 68 F

[56] References Cited

U.S. PATENT DOCUMENTS

| | | | |
|---|---|---|---|
| 50,841 | 11/1865 | Plott | 24/200 |
| 454,756 | 6/1891 | Neuville | 24/197 |
| 705,620 | 7/1902 | Specht | 24/198 |
| 2,064,447 | 12/1936 | Reutter | 24/200 |
| 3,206,816 | 9/1965 | Vilcins | 24/74 A |
| 3,414,943 | 12/1968 | Hattori | 24/74 A |
| 3,813,734 | 6/1974 | Schauweker | 24/200 |
| 3,967,347 | 7/1976 | Bickis | 24/74 A |
| 3,969,792 | 7/1976 | Hattori | 24/74 A |

FOREIGN PATENT DOCUMENTS

| | | | |
|---|---|---|---|
| 811,407 | 8/1951 | Fed. Rep. of Germany | 24/198 |

*Primary Examiner*—Bernard A. Gelak
*Attorney, Agent, or Firm*—Brisebois & Kruger

[57] ABSTRACT

A unitary packing band tightening device having a square frame and two parallel legs connected through a flexible hinge to one end of said frame, wherein ridges extend in the longitudinal direction on the top and bottom of the legs and on the top and bottom of both sides of the framework, and parallel to the legs, to prevent loosening of a tightened band.

9 Claims, 2 Drawing Figures

PACKING BAND TIGHTENING DEVICE

BACKGROUND OF THE INVENTION

Embossed polypropylene band has been widely used for packing goods and various synthetic resin-made tightening devices for such band are disclosed in the U.S. Pat. No. 3,206,816 and 3,414,943, but none are found to be satisfactory. When the band is thick, the legs of the tightening device are liable to be distorted due to a lack of mechanical strength; and even when the band is thin, the tightening device permits the band to get loose if a shock is applied to a folded portion of the tightened band, or near the tightening device.

SUMMARY OF THE INVENTION

The present invention relates to a packing band tightening device with improved anti-slip characteristics and increased mechanical strength.

The packing band tightening device according to the present invention is a device formed from synthetic resin and including a frame with a square opening and two parallel legs connected through a hinge to one end of the frame, and in which ridges are provided in the longitudinal direction on the top and bottom of said legs and on the top and bottom of both sides of the frame, parallel to the legs.

Thus by virtue of said ridges provided on the top and bottom of two sides of said framework and on the top and bottom of said legs, a prominent anti-slip effect is attained between the contacting surfaces of the band and its tightening device, thereby preventing a tightened band from loosening, the ridges increasing the mechanical strength of the device itself and minimizing a distortion of said legs of the device in service. It is for the purpose of ensuring the same effect regardless of the direction the hinge is bent, that the ridges are provided on both the top and the bottom of both the legs and the frame. The band tightening device according to the present invention may be integrally formed from a synthetic resin of polyolefin base such as polyethylene or polypropylene, thereby providing desired flexibility at the hinge.

The main object of the present invention is to provide anti-slip surfaces on the tightening device which contact surfaces of the band, thereby preventing a tightened band from getting loose.

Another object of the present invention is a band tightening device of increased mechanical strength.

Still another object of the present invention is a band tightening device with reinforced legs to minimize distortion of the leg of the tightening device in service.

Other objects and benefits of the present invention will become apparent from the following detailed account and the accompanying drawings.

DETAILED DESCRIPTION OF THE PREFERRED EMBODIMENT

Figure 1:
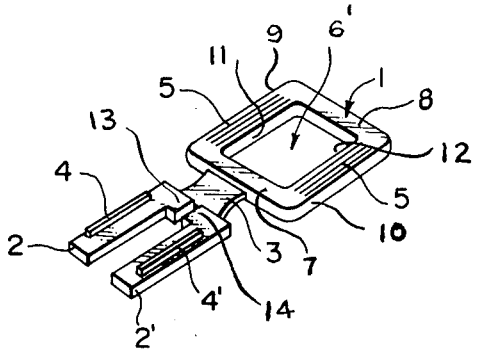
FIG. 1 is an oblique view illustrating a packing band tightening device according to the present invention.

Referring to the drawings, the present invention will now be described in detail.

The band tightening device according to the present invention is made of a polypropylene composition with inorganic additive, as a filler. As indicated in FIG. 1, it consists of the framework or frame 1 with a rectangular opening 6', which can be square, and two parallel legs 2, 2' connected by a hinge 3 from one end of said frame 1. Longitudinal ridges 4, 4' are provided on the top and bottom of the legs 2, 2'. The ridges 4, 4' on each side of the legs 2, 2' are desirably each a single, broad rib.

Frame 1 has ends 7 and 8, and sides 9 and 10, and the frame 1 is generally rectangular. On the top and bottom surface of sides 9 and 10 are ridges 5. The ridges 5 desirably comprise three narrow relatively shallow ribs on each of the sides 9 and 10, in contrast with the broader more prominent ribs 4, 4' of the legs. The ribs 5 preferably extend along the entire length of the sides of opening 6', and are parallel to legs 2, 2'. The ridges 5 of the frame are desirably, of a length the same as the width of the band to be used with the tightening device, and the length of opening 6', between ends 7 and 8 is slightly greater than the width of the band.

Preferably, the ridges or ribs 4, 4' of each of the legs are offset toward and are close to the outer edges of the legs so that these ridges extend into opening 6' of the frame at a location very close to the inside edges 11 and 12 of the respective sides 9 and 10.

In the preferred embodiment, each leg is approximately 4 mm thick and 6 mm wide. Ribs 4, 4' each have a height of 1.5 mm and a width on the order of 1.2 mm. By virtue of this arrangement, it is apparent that the ratio of the combined rib heights to the thickness of a leg is 3:4.

Figure 2:
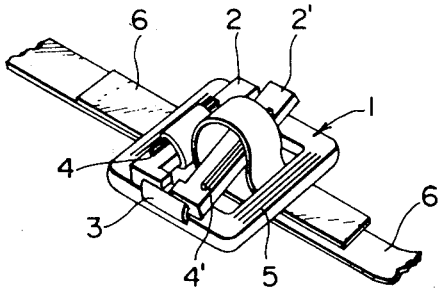
FIG. 2 is a view illustrating the manner in which the packing band tightened device is used.

The hinge 3 which connects legs 2 and 2' to end 7 of the frame is flexible, but wide with respect to its thickness, so that the hinge, while permitting the legs to be folded to the FIG. 2 position, resists sideways displacement of the legs. Each leg 2 and 2' has an inwardly extending projection 13, 14, which tends to resist rolling of the legs on frame 1 when the device is in use.

The use of the device is shown at FIG. 2. In use, each end of the embossed polypropylene band 6 is formed into a loop and the loop is extended through opening 6'. The legs 2, 2' are then folded inwardly from the position of FIG. 1 and are inserted through the loops. When the free ends of the band 6 are pulled, the band pulls the legs 2, 2' down tightly against the top surface of frame 1, ribs 4, 4' dig into the band, and the ridges 5 on the underside of frame 1 engage the upper portion of the band passing under the frame, to tightly grip the band.

The projections 13 and 14 cooperate with hinge 3 to resist rotation of legs 2, 2' as a result of the pull exerted by the band, after the band is tightened.

By virtue of the above arrangement, it is apparent that the band is held tightly and will not loosen even if the frame or band is subjected to shock or impact.

What is claimed is:

1. A band tightening device wholly of synthetic resin material and comprising

- a frame having sides and ends defining a generally rectangular opening;
- two parallel legs connected to an end of the frame by integral hinge means for hinging the legs for movement to a position seated on the ends of said frame;
- a longitudinal rib integral with and projecting upwardly from a top portion of each leg;
- a longitudinal rib integral with and projecting downwardly from a bottom portion of each leg; and
- ridges on the top and bottom of said sides and extending in the direction of said legs;

said ribs engaging a synthetic material packing band extending around said legs and under said sides of the frame to grip said bands without danger of cutting the material of the band, and reinforcing said legs to resist deformation under the action of the band; and wherein said ribs of each leg have a length less than the length of said rectangular opening, and said legs, in said seated position on the frame, each have a rib extending into the frame opening.

2. A band tightening device according to claim 1 wherein each rib of each leg comprises a single broad rib, and said ridges on the frame comprise three relatively narrow shallow ribs on the top and bottom of each of said sides.

3. A band tightening device according to claim 1 wherein said ribs of each leg are each offset towards an outside edge of a leg.

4. A band tightening device according to claim 1 wherein said ridges on said sides of the frame extend along the entire length of each side of said frame opening, each of said ridges being generally parallel to said legs.

5. A packing band tightening device according to claim 1 wherein said tightening device is a unitary polypropylene material device.

6. A packing band tightening device according to claim 5 wherein said polypropylene material contains an inorganic filler.

7. A packing band tightening device according to claim 3 wherein the ratio of the combined rib heights to the thickness of a leg is 3:4.

8. A band tightening device according to claim 1 wherein each leg includes only a single longitudinal rib at its top and bottom portions.

9. A band tightening device according to claim 1 further comprising, a flat seat on each leg at each end of a rib for seating on the ends of said frame.

* * * * *